US005518172A

United States Patent [19]

Nanno

[11] Patent Number: 5,518,172

[45] Date of Patent: May 21, 1996

[54] CARDBOARD CARTON FOR GRANULAR MATERIALS

[75] Inventor: Yukio Nanno, Osaka, Japan

[73] Assignee: The Procter & Gamble Company, Cincinnati, Ohio

[21] Appl. No.: 431,348

[22] Filed: Apr. 28, 1995

[51] Int. Cl.[6] ..... B65D 5/475; B65D 5/66

[52] U.S. Cl. ..... 229/125.05; 229/125.26; 229/125.29; 229/149

[58] Field of Search ..... 229/123.1, 125.05, 229/125.08, 125.26, 125.29, 145, 148

[56] References Cited

U.S. PATENT DOCUMENTS

| | | | |
|---|---|---|---|
| 2,570,145 | 10/1951 | Mettler | 229/145 |
| 2,711,282 | 6/1955 | D'Esposito | 229/125.29 |
| 2,847,151 | 8/1958 | Meyer-Jagenberg | 229/125.05 |
| 3,100,074 | 8/1963 | Beck | 229/148 |
| 3,326,447 | 6/1967 | Williamson | 229/44 |
| 3,893,614 | 7/1975 | Meyers | 229/145 |
| 3,910,486 | 10/1975 | Stone | 229/145 |
| 4,127,230 | 11/1978 | Bamburg et al. | 229/125.29 |
| 4,215,783 | 8/1980 | Vanderlust, Jr. | 229/145 |
| 4,314,643 | 2/1982 | Forbes, Jr. | 229/145 |
| 4,531,669 | 7/1985 | Osborne | 229/125.26 |
| 4,768,703 | 9/1988 | Sosler et al. | 229/125.05 |
| 5,040,722 | 8/1991 | Fromion et al. | 229/111.17 |

*Primary Examiner*—Gary E. Elkins
*Attorney, Agent, or Firm*—Ronald W. Kock

[57] ABSTRACT

A cardboard carton for granules includes a lid having a locking recess. The carton also includes a downwardly folded tab which cooperates with the locking recess on the lid to retain the lid closed. The locking tongue is formed by forming a slit in a face plate of a folded cardboard portion of the front panel. The locking tongue is in the position along the face plate by a sealing member before the first use by users. Therefore, the leakage of the granules from the slit portion of the front panel can be prevented. In addition, users will not erroneously recognize the locking tongue as a tab to be removed before use.

8 Claims, 12 Drawing Sheets

CARDBOARD CARTON FOR GRANULAR MATERIALS

FIELD OF THE INVENTION

The present invention relates to cardboard cartons for packaging granular materials such as powdered detergents.

BACKGROUND OF THE INVENTION

Generally known is a cardboard carton which is filled up with granular materials such as powdered detergents for containing the same. Such a cardboard carton is made of cardboard which is prepared from laminated synthetic resin or the like, to allow no permeation of moisture etc. The cardboard carton is generally provided with a box which is filled up with the granular materials, and a lid for closing an opening portion of the box. When the lid is attached to one side of the box, the lid is disadvantageously semi-opened by the elastic force of the cardboard when force for pressing the lid against the opening of the box is relieved, due to the elasticity of the cardboard.

In order to solve this problem, a locking tongue member is provided on an upper portion of a front panel of a box, as disclosed in U.S. Pat. No. 5,161,734, so that this locking tongue member and a locking recess which is formed in a from flap of a lid are shaped to be engageable with each other. According to this method, it is possible to lock the lid by inserting the locking tongue member in the locking recess.

FIG. 17 is a perspective view showing a conventional cardboard carton employing such a locking method. Referring to FIG. 17, a box 1 is in the form of a square box which is provided with an opening in its upper portion, and has a front panel 2, a back panel 3 and side panels 4 and 5. The box 1 is filled up with granular materials such as powdered detergents, and a sealing paper 6 serving as a sealing member is applied to the opening of the box 1. A lid 10 is attached to an upper portion of the back panel 3 of the box 1. The lid 10 is provided with a front flap 11 and side flaps 12 and 13 for covering the upper portions of the front panel 2 and the side panels 4 and 5 upon closure of the lid 10.

A locking tongue member 7 is provided on the upper portion of the front panel 2 of the box 1. On the other hand, a locking recess 1*a* is formed in an inner side of the front flap 11 of the lid 10, along the shape of the locking tongue member 7. This locking recess 11*a* is formed by applying auxiliary flaps 12*a* and 13*a* continuously extending from the side flaps 12 and 13 to the rear side of the front flap 11. A handle 15 which is made of synthetic resin or the like is attached to the upper portion of the box 1 through rivets 16 which are mounted on the side panels 4 and 5. An adhesive seal 17 is applied to the front flap 11 and the from panel 2 in a closed state of the lid 10, and generally removed when use of the carton is started.

When the lid 10 is closed, the locking tongue member 7 which is provided on the upper portion of the front panel 2 engages in the locking recess 11*a* provided in the inner side the lid 10, for locking the lid 10. Thus, the lid 10 is held in the closed state. The locking tongue member 7 is rotatable about a base portion on which the same is mounted. When the lid 10 is pushed up with slight force, therefore, the locking tongue member 7 is raised up to release the lid 10 from the locking state, so that the same can be opened.

The aforementioned conventional cardboard carton has the following problems:

When the consumer first opens the lid 10 after purchasing the carton, the sealing paper 6 is applied onto the box 1 and the locking tongue member 7 frontwardly projects in the state shown in FIG. 17. While it is necessary to separate the sealing paper 6 in the first place in order to take out the granular materials from the box 1, the consumer may erroneously recognize the locking tongue member 7, frontwardly projecting from a portion is under the sealing paper 6, as a tab for separating the sealing paper 6, to raise up and tear off the locking tongue member 7. When the locking tongue member 7 is thus removed, the locking mechanism for the lid 10 becomes inoperative.

Further, in a step of manufacturing the cardboard canon by filling up the same with the granular materials, while the sealing paper 6 is applied to the opening after the box 1 is filled up with the granular materials, the frontwardly projecting locking tongue member 7 is also glued and the sealing paper 6 cannot be applied in a normal state. When the sealing paper 6 is applied to the portion of the locking tongue member 7, the forward portion of the sealing paper 6 floats to readily define a clearance. When such a clearance is defined, the granular materials which is contained in the carton disadvantageously spills out to the exterior.

Due to such a projecting state of the locking tongue member 7, further, it is difficult to mechanically fill up the box 1 with the granular materials.

Therefore, an object of the present invention is to solve the aforementioned problems of the prior art and provide a cardboard carton which can prevent a consumer from erroneously separating a locking tongue member with a sealing paper, and suitable for mechanical filling of the content and capable of applying the sealing paper to a proper position in manufacturing steps.

SUMMARY OF THE INVENTION

A cardboard carton according to the present invention comprises a box which is formed with an opening in its upper portion and has front, back, side and bottom panels to be filled up with granular materials a locking tongue member which is defined by inwardly folding a plate member in an upper portion of the front panel of the box for forming a face plate and a rear plate which are superposed with each other, and forming a slit in the face plate with an upper end of the face plate serving as a base portion, an insertion hole which is formed by partially removing the face plate in a portion under the locking tongue member for receiving a finger for raising up the locking tongue member with respect to the face plate, a lid which is supported by an upper portion of the back panel of the box for closing the opening of the box, front and side flaps which are provided continuously from end portions of the lid for covering the upper portions of the front and side panels upon closure of the lid, a locking recess which is formed in an inner side of the front flap for locking the lid by engaging with the locking tongue member upon closure of the lid, and a sealing member for sealing and covering the opening of the box which is completely filled up with the granular materials, and is characterized in that the locking tongue member is in a position along the face plate before the sealing member is removed for starting use.

DETAILED DESCRIPTION OF THE INVENTION

Figure 1:
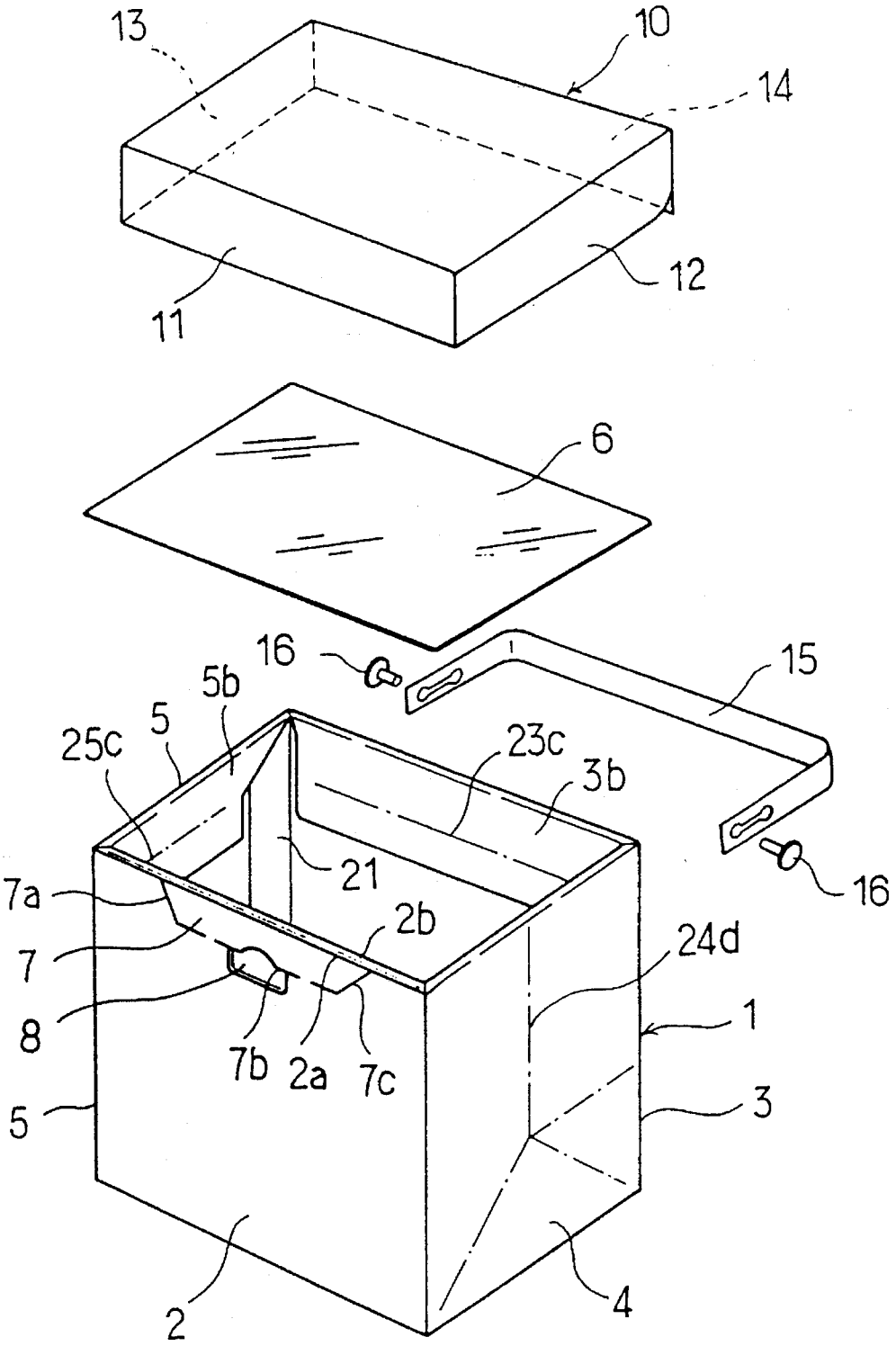
FIG. 1 is an exploded perspective view showing a cardboard carton of an embodiment according to the present invention.

In preferred embodiments, a cardboard carton according to the present invention comprises a box which is formed with an opening in its upper portion and has front, back, side and bottom panels to be filled up with granular materials a locking tongue member which is defined by inwardly folding a plate member in an upper portion of the front panel of the box for forming a face plate and a rear plate which are superposed with each other, and forming a slit in the face plate with an upper end of the face plate serving as a base portion, an insertion hole which is formed by partially removing the face plate in a portion under the locking tongue member for receiving a finger for raising up the locking tongue member with respect to the face plate, a lid which is supported by an upper portion of the back panel of the box for closing the opening of the box, front and side flaps which are provided continuously from end portions of the lid for covering the upper portions of the front and side panels upon closure of the lid, a locking recess which is formed in an inner side of the front flap for locking the lid by engaging with the locking tongue member upon closure of the lid, and a sealing member for sealing and covering the opening of the box which is completely filled up with the granular materials, and is characterized in that the locking tongue member is in a position along the face plate before the sealing member is removed for starting use.

In one of preferred modes according to the present invention, the slit is discontinuously formed in the face plate for defining the locking tongue member, so that the locking tongue member is held in the position along the face plate by presence of the discontinuous portion.

In another preferred mode according to the present invention, a rear side of the locking tongue member and the rear plate are partially glued thereby holding the locking tongue member in the position along the face plate.

In still another preferred mode according to the present invention, an adhesive seal is applied to the locking tongue member and a part of the face plate around its periphery, thereby holding the locking tongue member in the position along the face plate.

In the present invention, the lid may be integrally formed with the box, or may be formed independently of the box, to be attached to the box on the upper portion of the back panel.

In the present invention, further, the folded portion in the upper portion of the front panel of the box is preferably formed by providing a semi-slit in the plate member and thereafter folding the same. It is possible to superpose the face plate and the rear plate in close contact with each other by folding the plate member about the semi-slit. Thus, it is possible to prevent formation of a clearance between the face plate and the rear plate by superposing the face and rear plates in close contact with each other on the upper portion of the front panel, thereby preventing the granular materials from spilling out from the box to the exterior through such a clearance.

In the present invention, further, an inwardly depressed recess is preferably formed in a portion of the rear plate which is located on the insertion hole. Due to formation of such a recess, the finger can be easily inserted to readily raise up the locking tongue member.

FIG. 1 is an exploded perspective view showing a cardboard carton of an embodiment according to the present invention. Referring to FIG. 1, an opening is formed in an upper portion of a box 1, and the box 1 has a front panel 2, a back panel 3, side panels 4 and 5, and a bottom panel which is not shown in FIG. 1. As described later, upper portions of the front panel 2, the back panel 3, and the side panels 4 and 5 are formed by folding a cardboard plate member. In the upper portion of the front panel 2, therefore, a face plate 2*a*and a rear plate 2*b* are superposed with each other in a double structure. In this front panel 2, a semi-slit is provided in the folded portion, as described later.

In the upper portion of the front panel 2, slits 7*a*, 7*b*and 7*c*are formed in the face plate 2*a*, thereby defining a locking tongue member 7. The slits 7*a*, 7*b*and 7*c*are so discontinuously formed that the locking tongue member 7 is coupled with the face plate 2*a* through the discontinuous portions. The face plate 2*a* is partially cut to define an insertion hole 8 under the central portion of the locking tongue member 7. This insertion hole 8 is adapted to readily receive a finger for raising up the locking tongue member 7. In the upper portion of the back panel 3, a rear plate 3*b* is folded back and superposed. Also in the upper portion of the side plate 5, a rear plate 5*b* is folded back and superposed. Further, a rear plate (not shown) is folded back and superposed also in the side panel 4.

A handle 15 which is made of synthetic resin or the like is mounted on the side panels 4 and 5 of the box 1. The handle 15 is mounted by passing rivets 16 through holes which are formed in both end portions thereof and mounting the rivets 16 on the side panels 4 and 5. The handle 15 is mounted to be rotatable. Therefore, the handle 15 can be upwardly rotated when the consumer carries the cardboard carton.

A sealing paper 6 sewing as a sealing member is applied to the opening in the upper portion of the box 1. The sealing paper 6 can be prepared from a laminate sheet having a structure of sandwiching an OPP (oriented polypropylene) film between thin papers, or that having a structure of sandwiching a PET film between glassine papers, for example. When the sealing paper 7 is stuck to the upper portion of the box 1 by hot melting, on the other hand, a laminate sheet having a multilayer structure of a glassine paper, a PET film, another PET film and a hot melt adhesive layer can be employed. Such a sealing paper 6 is applied to the box 1 after the same is filled up with the granular materials. The locking tongue member 7 of the box 1, which is not in a raised state, will not hinder the operation of filling up the box 1 with the granular materials, and hence mechanical filling is enabled. Also when the sealing paper 6 is applied to the box 1, the locking tongue member 7 which is not in a raised state can be prevented from erroneous attachment of the sealing paper 6.

A lid 10 is attached to the upper portion of the back panel 3 shown in FIG. 1. An attachment flap 14 of the lid 10 is attached to the back panel 3 by an adhesive or the like. The lid 10 is provided with a front flap 11 and side flaps 12 and 13, which cover the upper portions of the front panel 2 and the side panels 4 and 5 respectively upon closure of the lid 10.

Figure 2:
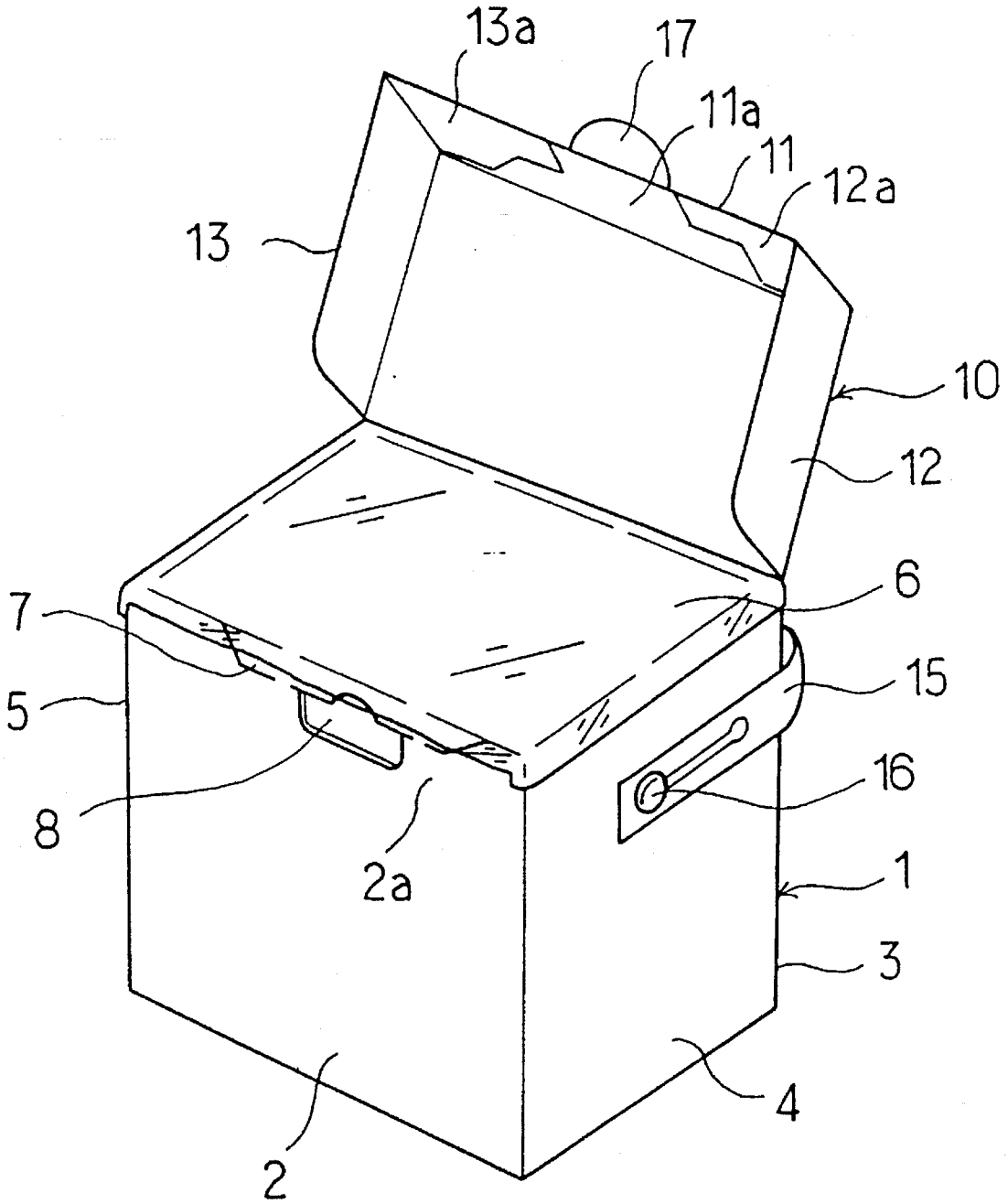
FIG. 2 is a perspective view showing the embodiment according to the present invention.

FIG. 2 is a perspective view showing such a state that the handle 15 is mounted on the box 1 shown in FIG. 1, while the sealing paper 6 is applied to the upper portion of the box 1 with attachment of the lid 10. As shown in FIG. 2, the locking tongue member 7 is not raised up but in a position along the face plate 2*a* when the sealing paper 6 is applied. Therefore, the consumer will not erroneously recognize the locking tongue member 7 as a tab for removing the sealing paper 6. In addition, the granular material in the box can be prevented from spilling out from the box to the exterior because the locking tongue member 7 is in the position along the face plate 2*a*.

Figure 3:
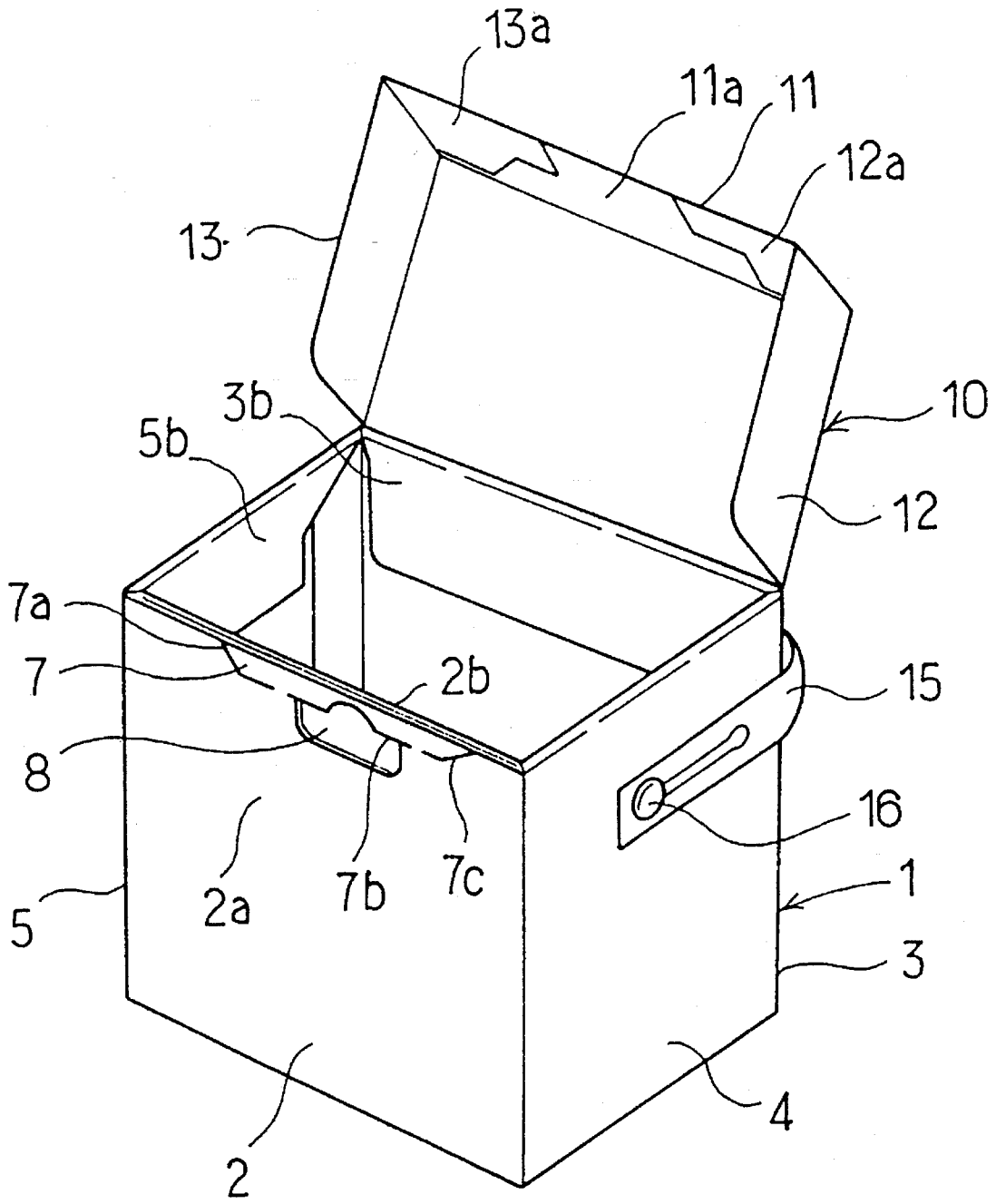
FIG. 3 is a perspective view showing the embodiment according to the present invention, from which a sealing member is removed.
Figure 4:
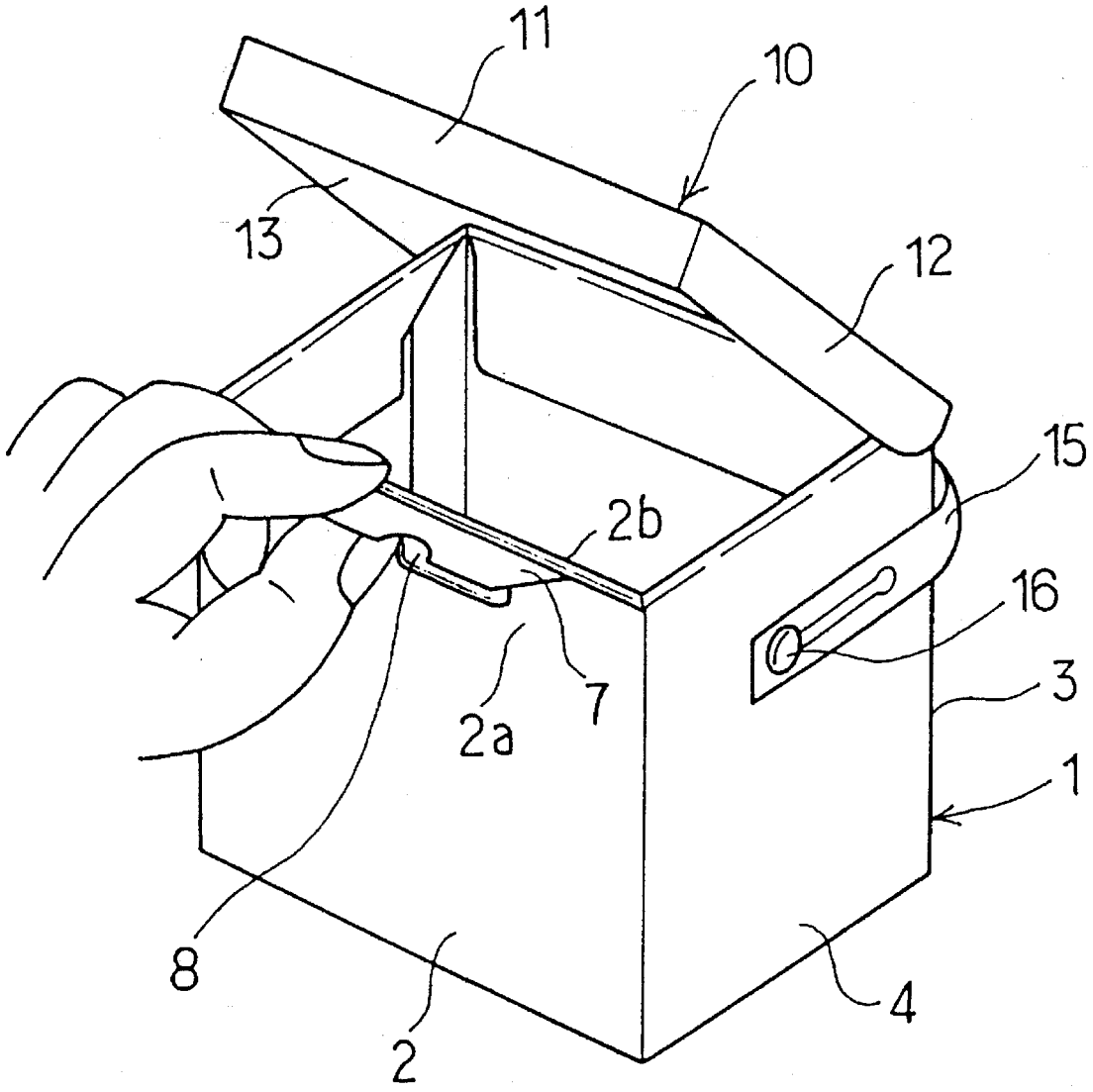
FIG. 4 is a perspective view showing the embodiment according to the present invention whose locking tongue member is raised up.

FIG. 3 shows such a state that the sealing paper 6 and the adhesive seal 17 are removed from the state shown in FIG. 2. Thus, the consumer first removes the sealing paper 6, in order to use the carton. Then, he or she inserts his or her finger in the insertion hole 8 to raise up the locking tongue member 7 with respect to the face plate 2*a*, as shown in FIG. 4. At this time, the discontinuous portions between the slits 7*a* mid 7*b* and between the slits 7*b* and 7*c* are so cut that the slits 7*a* to 7*c* are brought into a continuous state for defining the rotatable locking tongue member 7 with the upper end of the face plate 2*a* serving as a base portion. The locking tongue member 7 frontwardly projects due to elastic force of the cardboard, and hence the same engages in a locking recess 11*a* which is provided on the rear side of the front flap 11 of the lid 10 when the same is closed by rotation, thereby locking the lid 10. Thus, a locking state of the lid 10 is implemented.

In order to open the lid 10, on the other hand, the rotatable locking tongue member 7 is upwardly rotated in a direction for opening the lid 10 while slightly inwardly depressing the upper end portion of the front panel 2. Thus, the locking tongue member 7 is separated from the locking recess 11*a* to release the lid 10 from the locking state.

Figure 5:
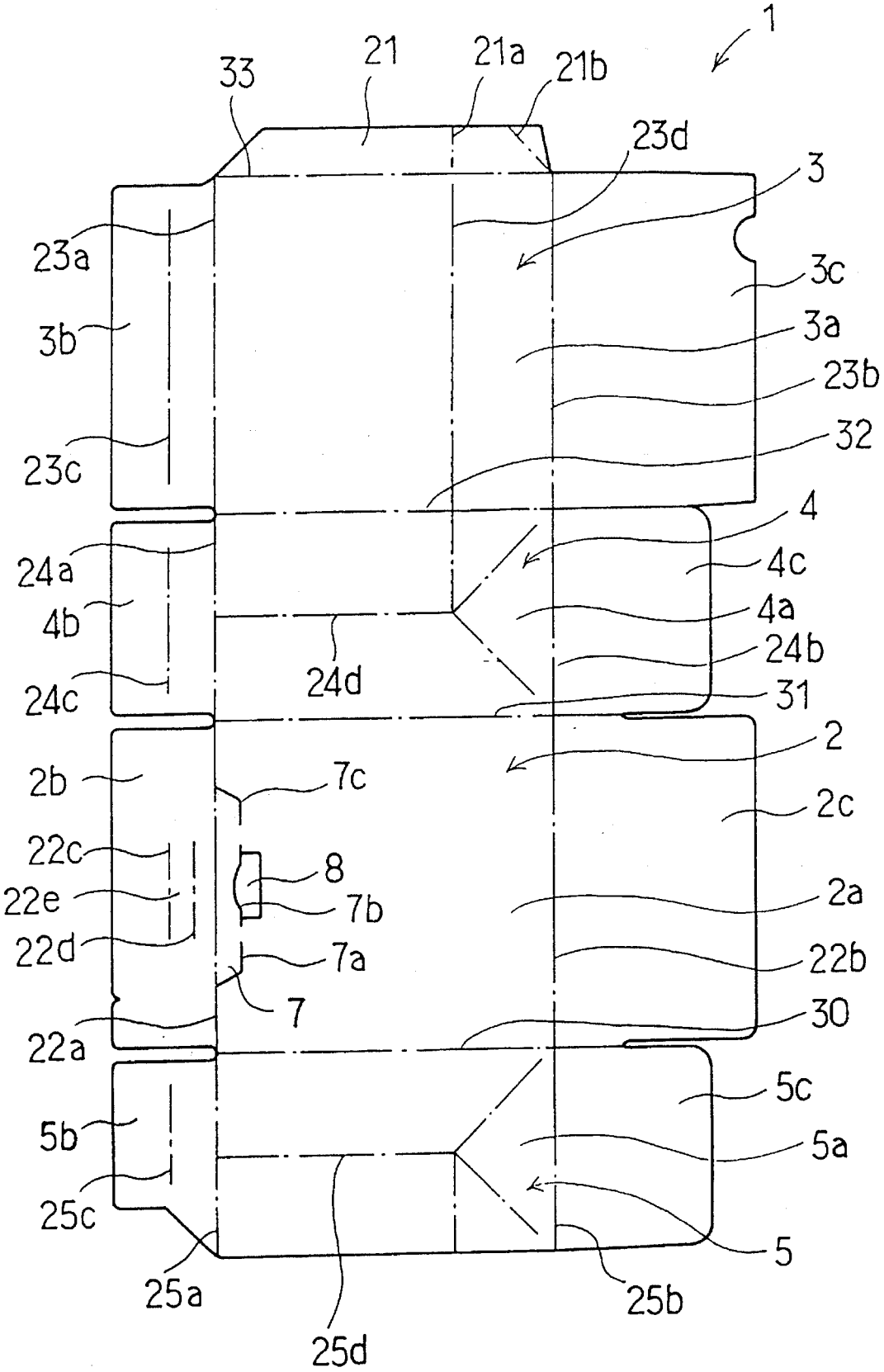
FIG. 5 is a development of a box provided in the embodiment according to the present invention.

FIG. 5 is a development of the box 1 according to the embodiment shown in FIG. 1. Referring to FIG. 5, the box 1 is formed by a single cardboard plate member in which the side panel 5, the front panel 2, the side panel 4, the back panel 3 and a glue panel 21 are coupled with each other. One-dot chain lines appearing in FIG. 5 show score lines. In the front panel 2, the rear plate 2*b* is provided continuously with the face plate 2*a* through a score line 22*a*, while a bottom plate 2*c* is provided continuously with the face plate 2*a* through a score line 22*b*. The face plate 2*a* is provided with the slits 7*a*, 7*b* and 7*c* for defining the locking tongue member 7. The portion of the insertion hole 8 is cut out. The rear plate 2*b* of the from panel 2 is provided with score lines 22*c* and 22*d*. These score lines 22*c* and 22*d* are arranged in positions corresponding to the insertion hole 8 when the rear plate 2*b* is folded about the score line 22*a*. An inwardly concave recess 22*e* is defined by formation of these score lines 22*c* and 22*d*, as described later. Further, the score line 22*a* is provided with a semi-slit, as described later.

The side panel 5 is provided continuously with the from panel 2 through a score line 30. The rear plate 5*b* and a bottom plate 5*c* are provided continuously with a face plate 5*a* of the side panel 5 through score lines 25*a* and 25*b* respectively. The rear plate 5*b* is provided with a score line 25*c*. Further, the face plate 5*a* of the side panel 5 is provided with four score lines 25*d*, as shown in FIG. 5. These score lines 25*d* are used for collapsing the carton after use.

The side panel 4 is provided continuously with the from panel 2 through a score line 31. A rear plate 4*b* and a bottom plate 4*c* are formed on both ends of a face plate 4*a* of the side panel 4 through score lines 24*a* and 24*b* respectively. The rear plate 4*b* is provided with a score line 24*c*. Further, the face plate 4*a* of the side panel 4 is provided with four score lines 24*d*, as shown in FIG. 5. These score lines 24*d* are also used for collapsing the carton after use, similarly to the score lines 25*d*.

The back panel 3 is provided continuously with the side panel 4 through a score line 33. Rear and bottom plates 3*b* and 3*c* are provided continuously with both end portions of a face plate 3*a* of the back panel 3 through score lines 23*a* and 23*b* respectively. The rear plate 3*b* is provided with a score line 23*c*. The face plate 3*a* is provided with a score line 23*d* which is connected with one of the score lines 24*d*. This score line 23*d* is also used for collapsing the carton after use, similarly to the score lines 25*d* and 26*d*.

The glue panel 21 is provided continuously with the back panel 3 through a score line 33. This glue panel 21 is a portion which is bonded and attached to an end portion of the face plate 5*a* of the side panel 5. The glue panel 21 is provided with score lines 21*a* and 21*b*, which are also used for collapsing the carton after use, similarly to the score lines 23*d* to 26*d*.

Figure 6:
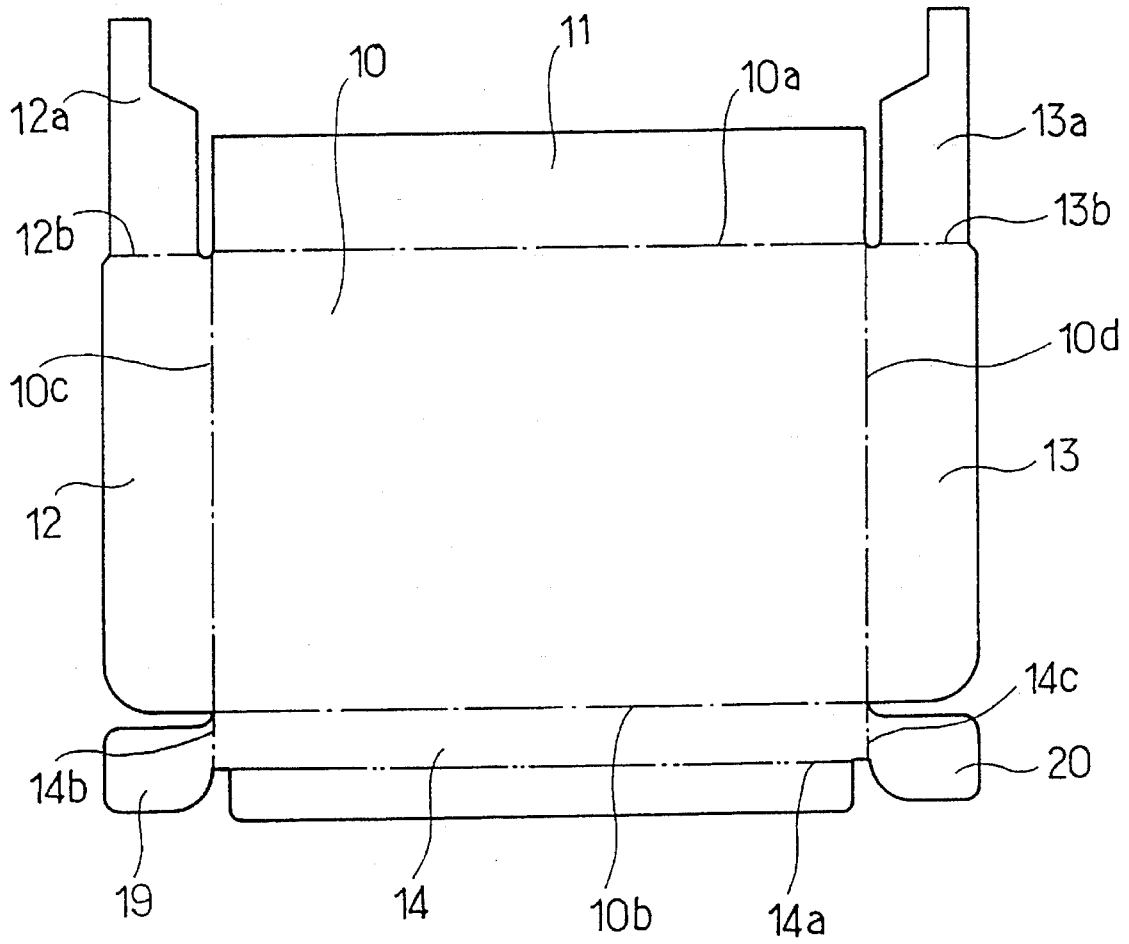
FIG. 6 is a development of a lid provided in the embodiment according to the present invention.
Figure 10:
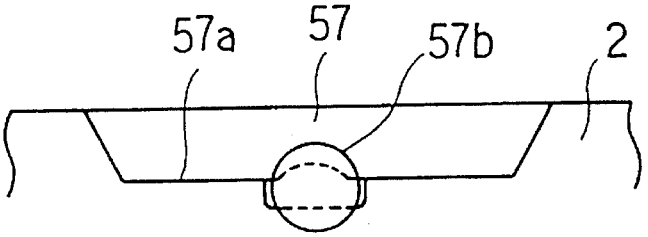
FIG. 10 is a front elevational view showing a locking tongue member in a further embodiment of the present invention.

FIG. 6 is a development of the lid 10. As shown in FIG. 10, the from flap 11, the attachment flap 14 and the side flaps 12 and 13 are continuously provided on four side portions of the lid 10 through score lines 10*a*, 10*b*, 10*c* and 10*d* respectively. The attachment flap 14 is bonded to the upper portion of the back panel 3 of the box 1. This attachment flap 14 is provided with a perforation line 14*a* for serving as a hinge for opening/closing the lid 10. Auxiliary flaps 19 and 20 are provided continuously with the attachment flap 14 through score lines 14*b* and 14*c* respectively.

On the other hand, auxiliary flaps 12*a* and 13*a* are provided continuously with the side flaps 12 and 13 through score lines 12*b* and 13*b* respectively. When the flaps 11, 14, 12 and 13 are folded about the score lines 10*a* to 10*d* for assembling the lid 10, the auxiliary flaps 12*a* and 13*a* are bonded to the rear side of the front flap 11 to define the locking recess 11*a* as shown in FIG. 2. The auxiliary flaps 19 and 20 are bonded to the inner sides of the side flaps 12 and 13 respectively when the lid 10 is assembled.

Figure 7:
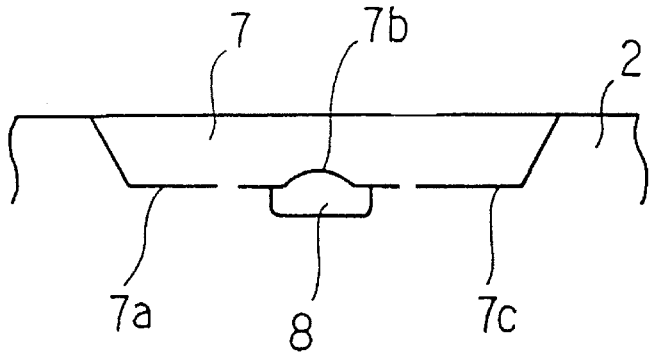
FIG. 7 is a front elevational view showing a portion around the locking tongue member in the embodiment according to the present invention.
Figure 8:
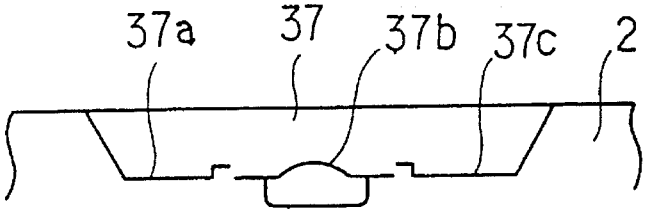
FIG. 8 is a front elevational view showing a locking tongue member in another embodiment according to the present invention.

FIG. 7 is a front elevational view showing a portion around the locking tongue member 7 in this embodiment. According to this embodiment, the locking tongue member 7 is defined by the discontinuous slits 7*a*, 7*b* and 7*c*. According to the present invention, however, formation of the locking tongue member is not restricted to such a structure, but a locking tongue member 37 may be defined by other types of slits 37*a*, 37*b* and 37*c* as shown in FIG. 8, for example.

Figure 9:
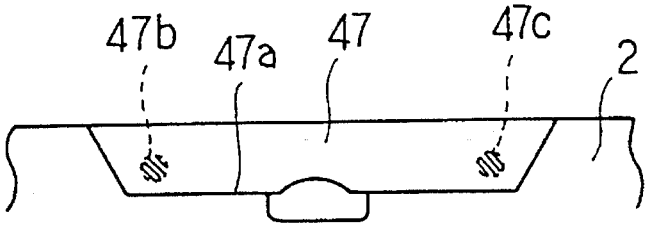
FIG. 9 is a front elevational view showing a locking tongue member in still another embodiment of the present invention.

Alternatively, a continuous slit may be provided so that the locking tongue member is suppressed from being raised up by another means. FIG. 9 shows such an embodiment, in which a locking tongue member 47 is defined by a continuous slit 47*a*. This locking tongue member 47 is naturally raised up by the elasticity of the cardboard plate member in this state, and hence glue portions 47*b* and 47*c* are provided between the rear side of the locking tongue member 47 and a back panel, for suppressing the locking tongue member 47 from being raised up. This locking tongue member 47 is separated from the glue portions 47*b* and 47*c*, to serve its function in use.

As shown in FIG. 10, further, a locking tongue member 57 may be defined by a continuous slit 57*a* so that this locking tongue member 57 is suppressed from being raised up by application of an adhesive seal 57*b*.

Figure 11:
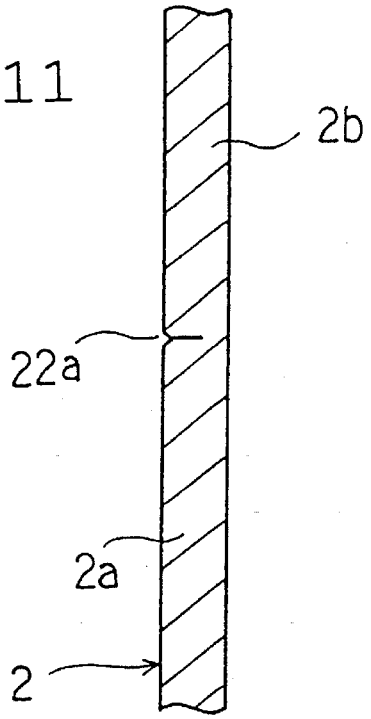
FIG. 11 is a sectional view showing an unfolded state of a foldable portion provided in a front panel in the embodiment according to the present invention.
Figure 12:
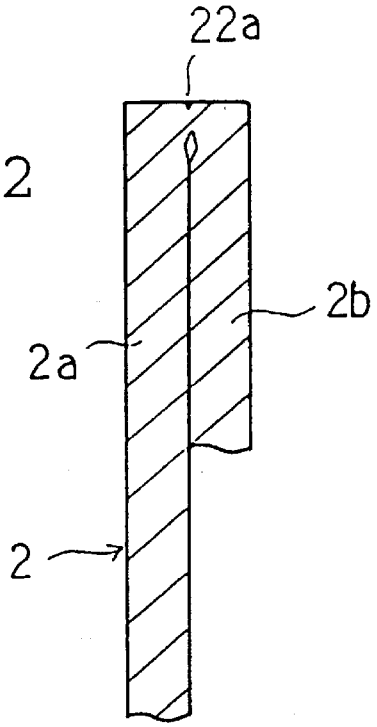
FIG. 12 is a sectional view showing a folded state of the foldable portion provided in the front panel in the embodiment according to the present invention.

FIG. 11 is a sectional view showing a folded portion of the front panel 2 according to this embodiment in an enlarged manner. As shown in FIG. 11, a semi-slit 22*a* is formed in the folded portion. The front panel 2 is folded about the portion provided with the semi-slit 22*a*, so that the face plate 2*a* and the rear plate 2*b*can be superposed in close contact with each other, as shown in FIG. 12. It is possible to prevent formation of a clearance between the face plate 2*a* and the rear plate 2*b* by superposing the plates 2*a* and 2*b* in close contact with each other. According to this embodiment, the insertion hole 8 is formed in the upper portion of the front panel 2. When a clearance is defined between the face plate 2*a* and the rear plate 2*b*, therefore, this clearance may communicate with the insertion hole 8 and the granular materials contained in the carton may spill out to the exterior through the insertion hole 8. According to this embodiment, the face plate 2*a* and the rear plate 2*b* are superposed in close contact with each other by formation of the semi-slit 2*a*, thereby further preventing spillage of the content. Such semi-slits may alternatively be formed in folded portions of the back panel 3 and the side panels 4 and 5.

Figure 13:
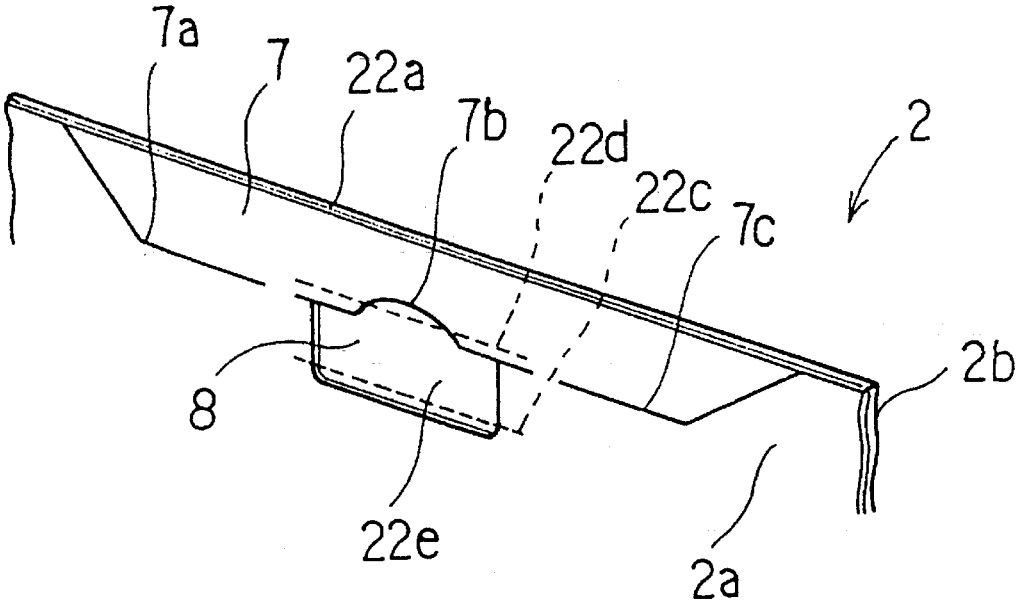
FIG. 13 is a perspective view showing an upper portion of the front panel in the embodiment according to the present invention.
Figure 14:
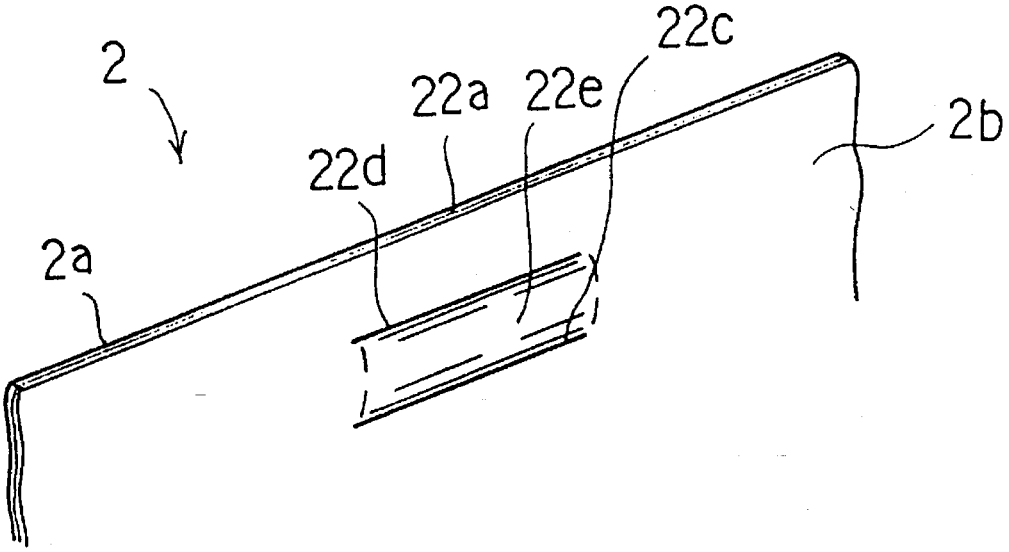
FIG. 14 is a perspective view showing the state of a rear side of the upper portion of the front panel in the embodiment according to the present invention.

FIG. 13 is a perspective view showing the upper portion of the front panel 2, and FIG. 14 is a perspective view showing the upper portion of the front panel 2 as viewed from the rear side. As hereinabove described, the score lines 22*d* and 22*c* are formed in the rear plate 2*b*, for defining the inwardly concave recess 22*e*. This recess 22*e* is arranged on a position corresponding to the insertion hole 8. Therefore, the finger can be further readily inserted in the insertion hole 8.

Figure 15:
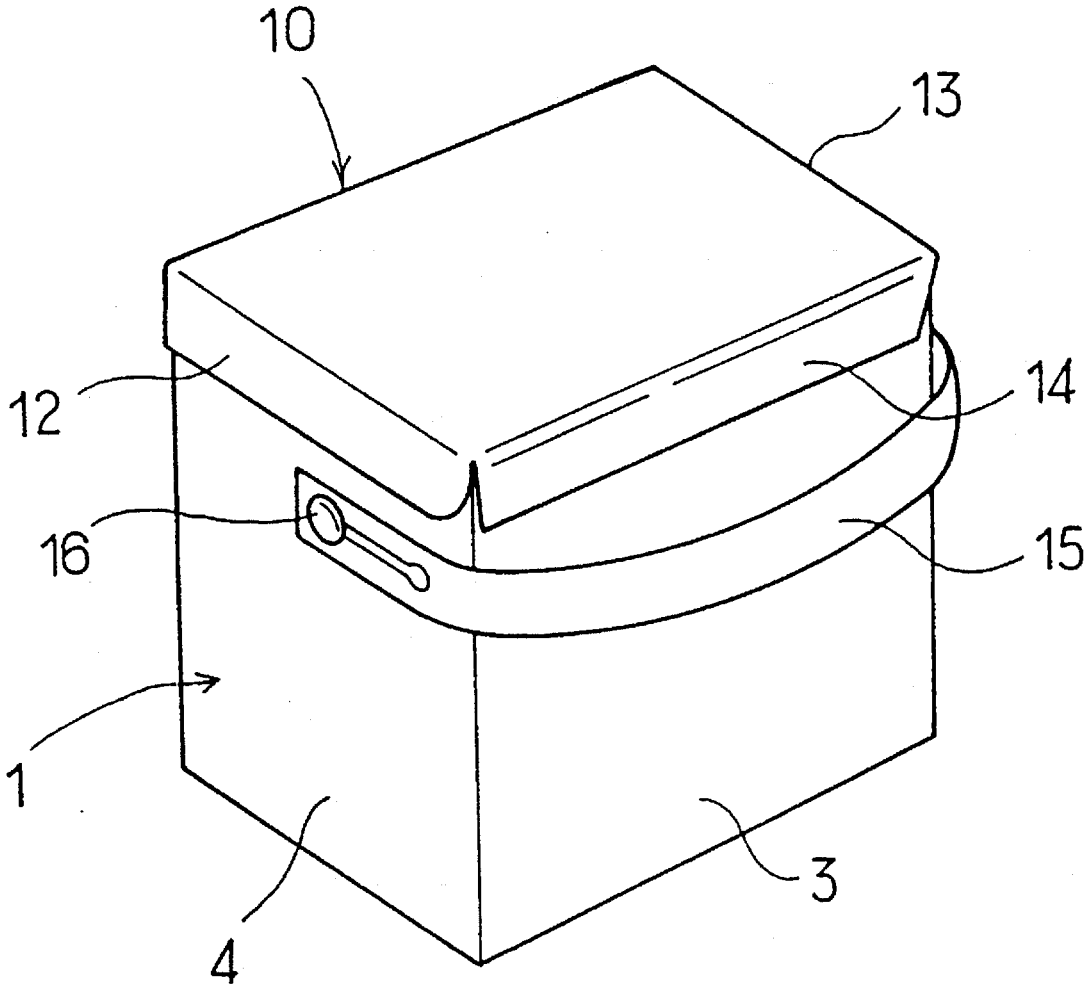
FIG. 15 is a perspective view showing the embodiment according to the present invention as viewed from the back side.

FIG. 15 a perspective view showing the cardboard carton according to the aforementioned embodiment as viewed from the back side. As shown in FIG. 15, the attachment flap 14 of the lid 10 is bonded to the upper portion of the back panel 3 of the box 1.

Figure 16:
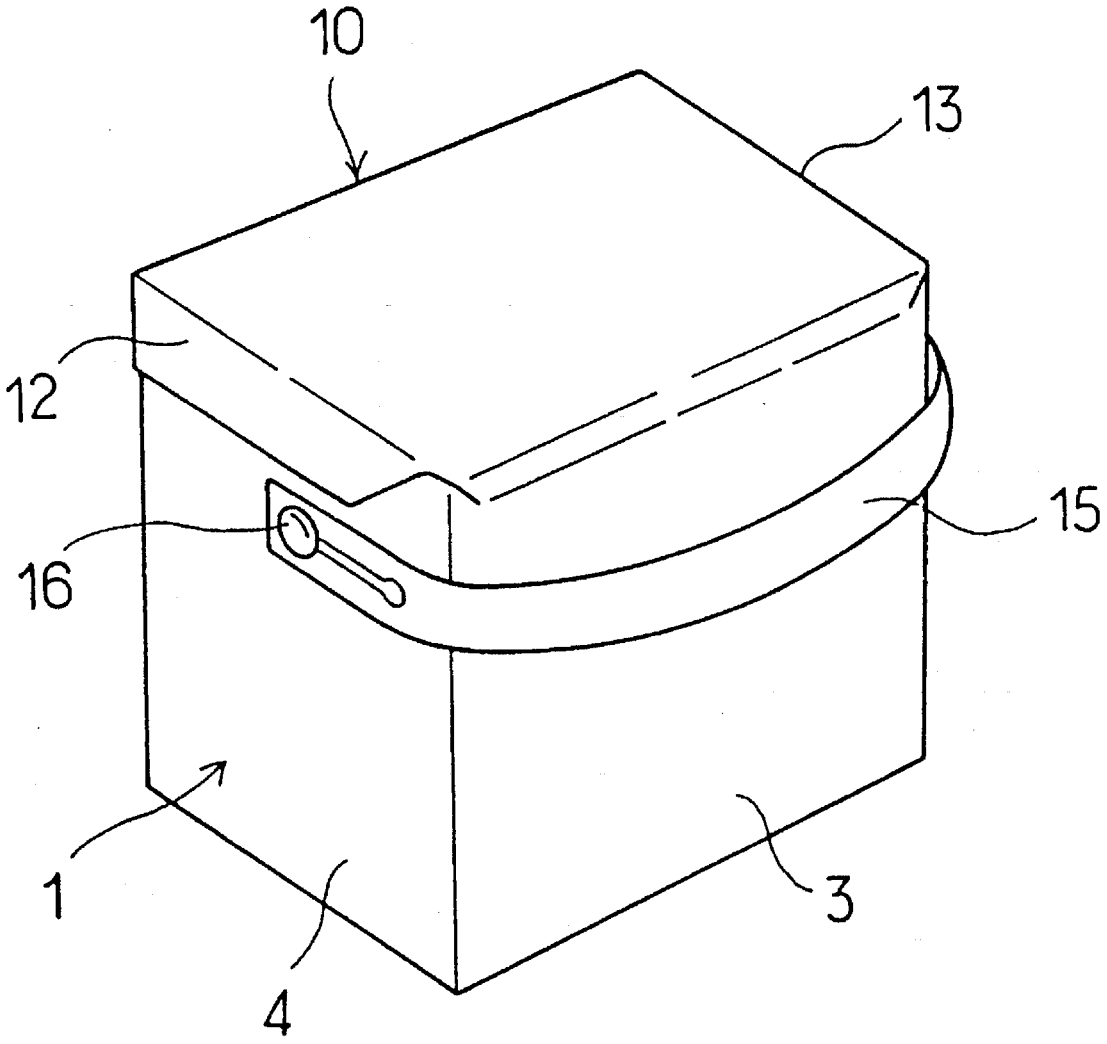
FIG. 16 is a perspective view showing another embodiment according to the present invention as viewed from the back side.
Figure 17:
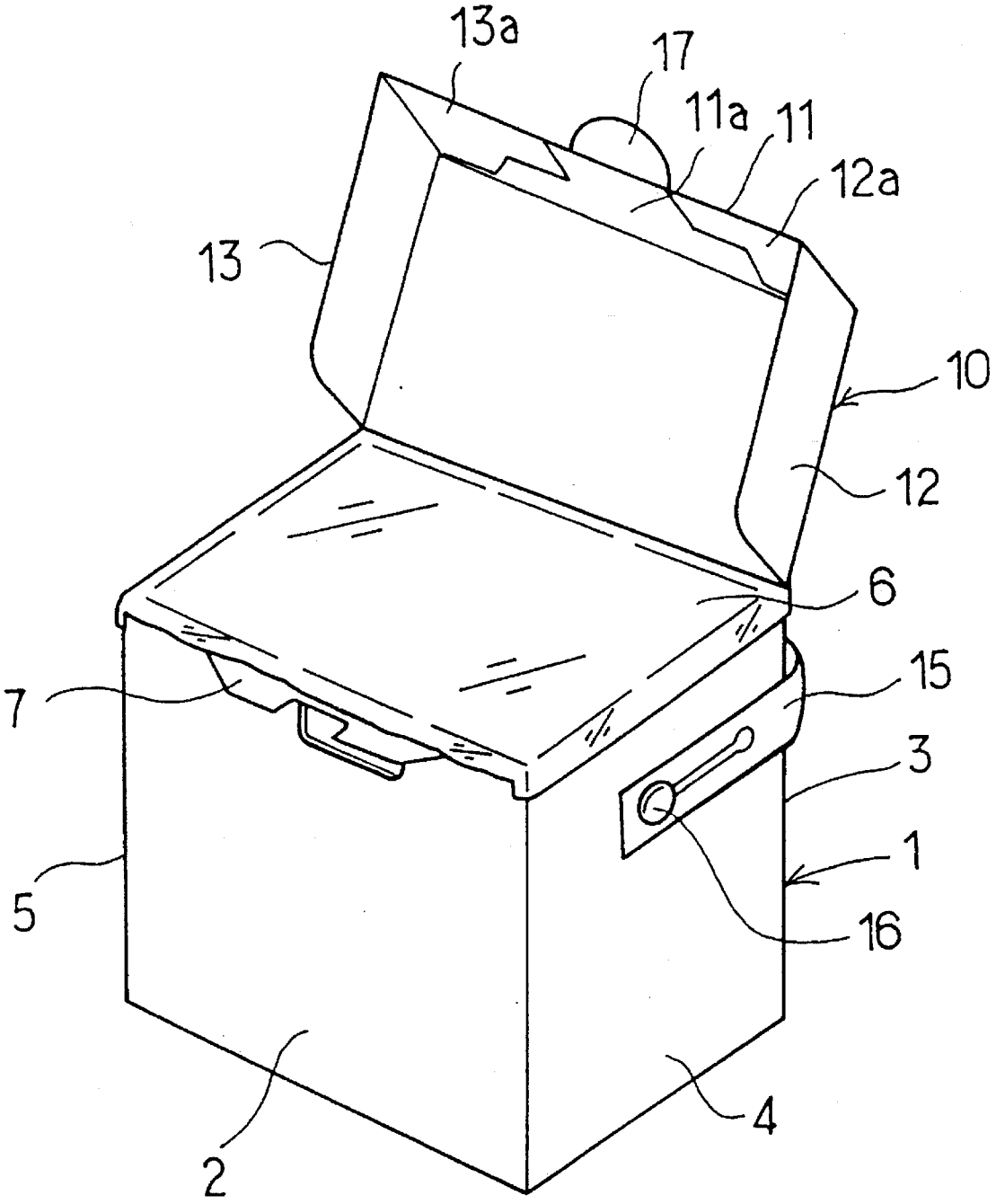
FIG. 17 is a perspective view showing a conventional cardboard carton.

FIG. 16 is a perspective view showing a cardboard carton of another embodiment according to the present invention as viewed from the back side, similarly to FIG. 15. In the embodiment shown in FIG. 16, a lid 10 is integrally formed with a box 1. This lid 10 is provided continuously with an upper portion of a back panel 3. As understood from the embodiment shown in FIG. 16, the cardboard carton according to the present invention is not restricted to that having an independent lid.

What is claimed is:

1. A cardboard carton for containing granular materials, comprising:

a box being formed with an opening in its upper portion and having front, back, side and bottom panels, to be filled up with said granular materials;

a locking tongue member being defined by inwardly folding a plate member in an upper portion of said front panel of said box for forming a face plate and a rear plate being superposed with each other, and forming a slit in said face plate with an upper end of said face plate serving as a base portion; wherein said face plate has an insertion hole being formed by partially removing said face plate in a portion under said locking tongue member for receiving a finger for raising up said locking tongue member with respect to said face plate;

a lid being supported by an upper portion of said back panel of said box for closing said opening of said box;

front and side flaps being provided continuously from end portions of said lid for covering said upper portions of said front and side panels upon closure of said lid;

a locking recess being formed in an inner side of said front flap for locking said lid by engaging with said locking tongue member upon closure of said lid; and a sealing member for sealing and covering said opening of said box being filled up with said granular materials, said locking tongue member being in the position along said face plate before said sealing member is removed for starting use.

2. The cardboard carton in accordance with claim 1, wherein said slit is discontinuously formed in said face plate for defining said locking tongue member, said locking tongue member being held in said position along said face plate by presence of said discontinuous portion.

3. The cardboard carton in accordance with claim 1, wherein a rear side of said locking tongue member and said rear plate are partially glued thereby holding said locking tongue member in said position along said face plate.

4. The cardboard carton in accordance with claim 1, wherein an adhesive seal is applied to said locking tongue member and a pan of said face plate around its periphery, thereby holding said locking tongue member in said position along said face plate.

5. The cardboard carton in accordance with claim 1, wherein said lid is integrally formed with said box.

6. The cardboard carton in accordance with claim 1, wherein said lid is independently formed of said box, and attached to said box on said upper portion of said back panel.

7. The cardboard carton in accordance with claim 1, wherein said folded portion in said upper portion of said front panel of said box is formed by providing a semi-slit in a plate member and thereafter folding the same.

8. The cardboard carton in accordance with claim 1, wherein an inwardly depressed recess is formed in a portion of said rear plate being located on said insertion hole.

* * * * *

UNITED STATES PATENT AND TRADEMARK OFFICE
CERTIFICATE OF CORRECTION

PATENT NO. : 5,518,172

DATED : May 21, 1996

INVENTOR(S) : Yukio Nanno

It is certified that error appears in the above-identified patent and that said Letters Patent is hereby corrected as shown below:

Column 1, line 29, "from" should read -- front --.

Column 4, line 54, "2*a*and" should read -- 2*a* and --.

Column 4, line 57, "7*b*and" should read -- 7*b* and --.

Column 4, line 59, "7*b*and 7*c*are" should read -- 7*b* and 7*c* are --.

Column 5, line 12, "sewing" should read -- serving --.

Column 5, line 58, "mid" should read -- and --.

Column 6, line 26, "from" should read -- front --.

Column 6, line 34, "from" should read -- front --.

Column 6, line 61, "from" should read -- front --.

Column 8, line 52, "pan" should read -- part --.

Signed and Sealed this

Tenth Day of April, 2001

*Attest:*

Nicholas P. Godici

NICHOLAS P. GODICI

*Attesting Officer*

*Acting Director of the United States Patent and Trademark Office*